US006361202B1

(12) United States Patent
Lee et al.

(10) Patent No.: US 6,361,202 B1
(45) Date of Patent: Mar. 26, 2002

(54) STATIC MIXER FOR A VISCOUS LIQUID

(75) Inventors: Hang-Chang Lee, Tao-Yuan; Long Chun Tsai, Hsin-chu, both of (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/727,851

(22) Filed: Dec. 1, 2000

(51) Int. Cl.[7] ..... B01F 5/04

(52) U.S. Cl. ..... 366/165.2; 366/174.1; 366/181.5; 366/339; 366/137; 366/165.5; 366/173.1

(58) Field of Search ..... 366/165.2, 165.5, 366/167.1, 173.1, 173.2, 174.1, 175.2, 181.5, 136, 137, 336, 338, 339, 341

(56) References Cited

U.S. PATENT DOCUMENTS 4,443,111 A * 4/1984 Minaire
5,632,962 A * 5/1997 Baker et al.
5,782,556 A * 7/1998 Chu
6,109,778 A * 8/2000 Wilmer

* cited by examiner

*Primary Examiner*—Charles E. Cooley
(74) *Attorney, Agent, or Firm*—Tung & Associates

(57) ABSTRACT

A static mixer for a viscous liquid for use in a chemical mechanical polishing process is provided. The static mixer is constructed of an elongated cylindrical tank, an elongated cylindrical mixing sleeve having a multiplicity of mixing apertures therethrough situated inside the tank, a plurality of curvilinear feed tubes situated at a top of the tank cavity for feeding a mixture of a viscous liquid and a solvent into the tank cavity, a spiral plate mounted on the interior surface of the tank wall extending continuously from a top wall to a bottom wall of the tank cavity, and an outlet tube that is situated at the bottom of the tank cavity inside the mixing sleeve for outputting a mixture.

16 Claims, 2 Drawing Sheets

STATIC MIXER FOR A VISCOUS LIQUID

FIELD OF THE INVENTION

The present invention generally relates to a mixing device for a viscous liquid and more particularly, relates to a static mixer for a viscous liquid that is constructed of an elongated cylindrical tank, an elongated cylindrical mixing sleeve inside the tank, a plurality of curvilinear tubes for feeding the viscous liquid, a spiral plate for guiding the liquid flow, and an outlet tube for outputting a mixture of the viscous liquid and a solvent.

BACKGROUND OF THE INVENTION

Apparatus for polishing thin, flat semi-conductor wafers is well-known in the art. Such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semi-conductor wafer during the fabrication of semi-conductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. It is known in the art that uniformity in wafer polishing is a function of pressure, velocity and the concentration of chemicals. Edge exclusion is caused, in part, by non-uniform pressure on a wafer. The problem is reduced somewhat through the use of a retaining ring which engages the polishing pad.

In the polishing operation shown in the enlarged cross-sectional view of FIG. 1B, the slurry solution 24 must be forced into an interface between the wafer 10 and the polishing pad 12 in order for the chemical reaction and the mechanical removal process 20 to operate efficiently. The slurry solution 24 (also shown in FIG. 1A) is dispensed from a dispensing nozzle (not shown) onto the polishing pad 12. In most commercial CMP apparatus, the slurry solution 24 is stored in a reservoir and delivered to the dispensing nozzle through a conduit. The slurry solution stored in the reservoir and in the delivering conduit is not provided with a temperature control device. The slurry solution 24 is normally applied to the polishing pad 12 at the same temperature as the chamber temperature in the CMP apparatus, i.e., approximately at room temperature.

The slurry solution is normally delivered by a commercial supplier in a preset concentration which must be diluted by a solvent such as ultra-pure water (UPW) for a specific CMP process. Conventionally, the dilution of the viscous slurry solution by a solvent can be accomplished in a dynamic mixer utilizing a propeller type mixing blade for producing a turbulent flow in the solution to achieve mixing. The mixing efficiency achieved by the dynamic mixer is poor and furthermore, the dynamic mixer frequently occupies a large floor space.

More recently, static mixers have been used which utilize a static mixing mechanism without using any mechanical moving parts. In a typical static mixer, the mixer and the mixing tank assembly are combined into one unit to minimize the floor space used in a factory. Factory space utilization has become more important in the present deep-sub-micron fabrication environment, since global planarization has become an essential process for achieving high IC device density on the chips fabricated. In a global planarization process that is carried out by chemical mechanical polishing, slurries are adapted as an abrasive material for producing the planarization effect. For cost reduction purposes, it has become more effective to dilute concentrated slurry solutions with solvents, i.e. ultra-pure water. The slurry blending requirements vary from process to process. However, a slurry mixer must blend slurry in large volumes to a tool-specific blend ratio. In other words, a high mixing efficiency and a reliable viscous liquid mixer are critical requirements in the present deep-sub-micron fabrication environment. For instance, a slurry mixer may be used to blend either a two-component slurry, i.e. a tungsten slurry that has different pH values. When a mixing process is not properly conducted, a slurry of unstable quality is obtained which may lead to increased crystallization of the slurry solution and an increasing probability of pH shock.

Referring now to FIG. 1C, wherein a typical static mixer utilized in slurry dilution for a CMP process is shown. The static mixer system 30 is constructed of a mixing tank 32 containing a cavity 34 therein for conducting the mixing process. The mixing tank 32 is essentially empty in the cavity 34 with no mixing aid built therein. Into the cavity 34, is fed through an to inlet conduit 36 a slurry solution from a slurry conduit 38 fed by a slurry pump 40, an oxidizer solution 42 (used in a tungsten CMP process) fed by an oxidizer pump 44, and ultra-pure water through a water conduit 46 fed by a water pump 48. Simultaneously, a recirculated slurry solution is fed into the inlet conduit 36 by a recirculating pump 50 through conduit 52 for recycling the slurry solution 54 contained in the cavity 34. On the side of the static mixer tank 32, is provided a sight tube 56 including a plurality of level sensors 58.

While the static mixer 30 shown in FIG. 1C provides some benefits over the dynamic mixer previously utilized, the mixing tank 32 does not provide high efficiency mixing for the slurry solution 54 contained in the cavity 34.

It is therefore an object of the present invention to provide a static mixer for a viscous liquid that does not have the drawbacks or shortcomings of the conventional static mixers.

It is another object of the present invention to provide a static mixer for a viscous liquid that can be designed with a minimal utilization of floor space in a semiconductor fabrication facility.

It is a further object of the present invention to provide a static mixer that has improved construction inside the mixing tank for achieving high efficiency mixing.

It is another further object of the present invention to provide a static mixer for a viscous liquid that has a specially designed mixing chamber inside the mixing tank.

It is still another object of the present invention to provide a static mixer for a viscous liquid that utilizes a mixing tank equipped with an elongated cylindrical mixing sleeve positioned inside the tank.

It is yet another object of the present invention to provide a static mixer for a viscous liquid wherein the mixing tank is equipped with an elongated cylindrical mixing sleeve and a plurality of curvilinear liquid feeding tubes situated on top of the tank cavity.

It is still another further object of the present invention to provide a static mixer for a viscous liquid that is equipped with a mixing tank constructed with a spiral plate along an inside surface of the tank sidewall extending continuously from a top of the cavity to a bottom of the cavity.

It is yet another further object of the present invention to provide a static mixer for a viscous liquid wherein a mixing tank is constructed with an elongated cylindrical mixing sleeve, a plurality of curvilinear feed tubes, a spiral plate positioned on an inside surface of the sidewall of the tank, and an outlet tube situated at a bottom of the tank and inside the mixing sleeve for outputting a diluted mixture of the viscous liquid.

SUMMARY OF THE INVENTION

In accordance with the present invention, a static mixer for diluting a viscous liquid by a solvent for use in a semiconductor fabrication process is disclosed.

In a preferred embodiment, a static mixer for a viscous liquid is provided which includes an elongated cylindrical tank that has a cavity and a first diameter defined by a tank wall; an elongated cylindrical mixing sleeve that has a second diameter smaller than the first diameter situated inside the tank cavity, the mixing sleeve has a multiplicity of mixing apertures therethrough; a plurality of curvilinear tubes situated near a top wall of the tank for flowing a mixture of the viscous liquid and a solvent into the tank cavity, each of the plurality of curvilinear tubes has an outlet extending outwardly away from a center of the tank cavity toward an interior surface of the tank wall generating a spiral flow of the mixture; a spiral plate that has a predetermined width positioned on the interior surface of the tank wall extending continuously from the top wall to a bottom wall of the tank; and an outlet tube situated at the bottom of the tank and inside the mixing sleeve for outputting the mixture.

The static mixture for a viscous liquid may further include a plurality of level sensors for sensing a level of the mixture or a sight tube mounted on a sidewall of the elongated cylindrical tank for observing a level of the mixture. The static mixer may further include a mixing sleeve mounted in an upright position inside the tank cavity when the elongated cylindrical tank is mounted in an upright position. The multiplicity of mixing apertures in the mixing sleeve may have a diameter between about 3 mm and about 15 mm, or more preferably a diameter between about 5 mm and about 10 mm. The second diameter of the mixing sleeve may be at least 2 cm smaller than the first diameter of the elongated cylindrical tank. The plurality of curvilinear tubes may be arranged such that each two of the tubes is in an S-shape with two outlets pointing toward the interior surface of the tank wall.

In the static mixer for a viscous liquid, the spiral plate may be arranged along the interior surface of the tank wall for guiding the spiral flow of the mixture to the bottom wall of the tank and to enter the mixing sleeve through the mixing apertures. The predetermined width of the spiral plate may be less than 10% of the first diameter of the elongated cylindrical tank, or may be less than 2 cm. The static mixer may further include a pump means in fluid communication with the outlet tube for withdrawing the mixture from the tank cavity. The plurality of curvilinear tubes may further include an inlet in fluid communication with at least two inlet conduits, wherein the at least two inlet conduits may be a slurry feed conduit and a solvent feed conduit. The at least two inlet conduits may be three conduits of a slurry feed conduit, a solvent feed conduit and a recirculating slurry conduit. The plurality of curvilinear tubes may be fixedly mounted to the top wall of the tank. The spiral plate may be fixedly mounted on the interior surface of the tank wall by welding means. The plurality of curvilinear tubes may be at least four tubes each having an outlet pointing toward the interior surface of the tank wall.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

Figure 1A:
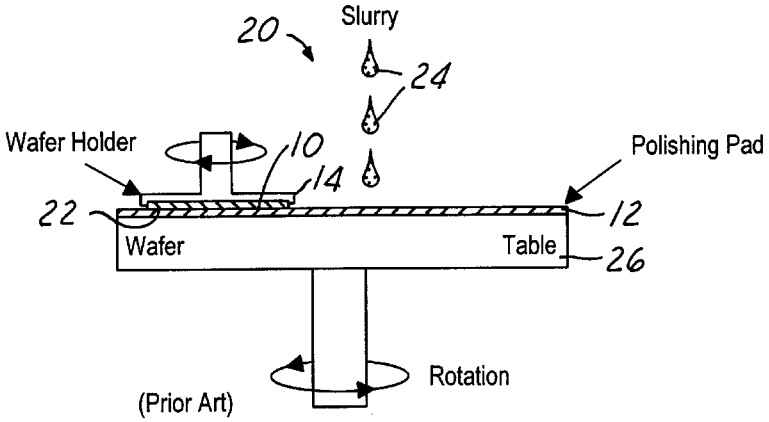
(Prior Art) FIG. 1A
FIG. 1A is a cross-sectional view of a conventional chemical mechanical polishing apparatus.
Figure 1B:
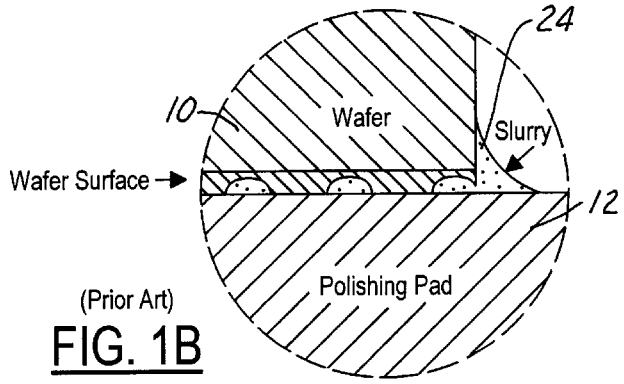
(Prior Art) FIG. 1B
FIG. 1B is a partial, enlarged, cross-sectional view illustrating a slurry interaction between a wafer surface and a polishing pad.
Figure 1C:
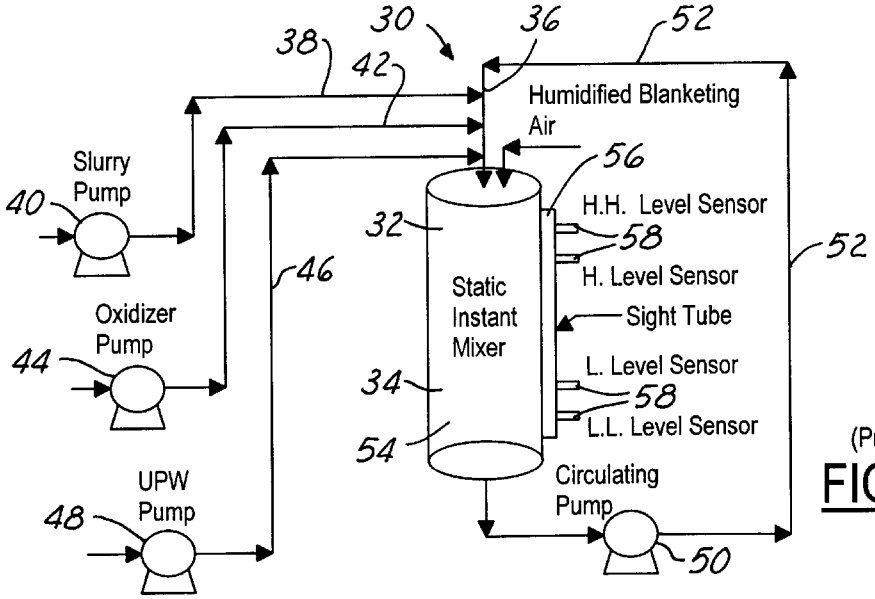
(Prior Art) FIG. 1C
FIG. 1C is a view illustrating a conventional static mixer and the feed conduit into the mixer.

The present invention discloses a static mixer for a viscous liquid that can be used for the efficient mixing of any high viscosity liquid and particulary, for a high viscosity slurry solution used in a chemical mechanical polishing apparatus.

The static mixer of the present invention can be constructed of an elongated cylindrical tank body, an elongated cylindrical mixing sleeve positioned in the tank body, a plurality of curvilinear feed tubes for feeding the viscous liquid into the tank body, a spiral plate, and an outlet tube for outputting a mixture. The elongated cylindrical tank body has a cavity therein defined by a tank wall. The tank body has a first diameter in the cavity. The elongated cylindrical mixing sleeve has a second diameter smaller than the first diameter and is situated inside the tank cavity. The mixing sleeve further has a multiplicity of mixing apertures therethrough. The plurality of curvilinear feed tubes is situated near a top wall of the tank for flowing a mixture of a viscous liquid and a solvent into the tank cavity. Each of the plurality of curvilinear tubes has an outlet extending outwardly away from a center of the tank cavity toward an interior surface of the tank wall to generate a spiral flow of the mixture. The spiral plate has a predetermined width of approximately 10% of the diameter of the tank body, and is positioned on the interior surface of the tank wall extending continuously from a top wall to a bottom wall of the tank. The outlet tube is positioned in the bottom wall of the tank and inside the mixing sleeve for outputting a mixture of the viscous liquid and a solvent.

The present invention novel static mixture provides improved mixing efficiency and furthermore, minimizes a possible pH shock by blending raw chemicals with recirculating pre-mixed slurry. The apparatus is capable of decreasing the potential for slurry crystallization and minimizing pH shock in the mixed fluid. By utilizing the present invention novel apparatus, a slurry solution can be mixed in large volume with consistent quality and viscosity.

The present invention novel static mixer can be used to blend either a two-component slurry solution, i.e. an oxide slurry, or a three-component slurry solution, i.e. a tungsten slurry that has various pH values. Numerous processing advantages can be achieved by the present invention novel apparatus. For instance, the static mixer does not require any mechanical moving parts and therefore, the maintenance of the apparatus is minimized. Secondly, the mixing tank of the present invention static mixer occupies a small volume and thus a small factory floor space.

When a slurry solution with a density of 1.16 gm/cc is mixed with ultra-pure water that has a density of 1.0 gm/cc, a slurry solution with a density of 1.075 gm/cc is obtained. Such slurry solution may be one that contains $SiO_2$ particles having 0.015 $\mu$m diameter in a KOH solution. It has been found that the present invention novel static mixer can be used effectively to minimize the potential of pH shock in a mixed solution, i.e. the pH of the mixed solution may be reduced to about 10.8 from an initial value of 11.2. This eliminates the pH shock potential that normally occurs at a pH between about 8 and about 9.

Figure 2A:
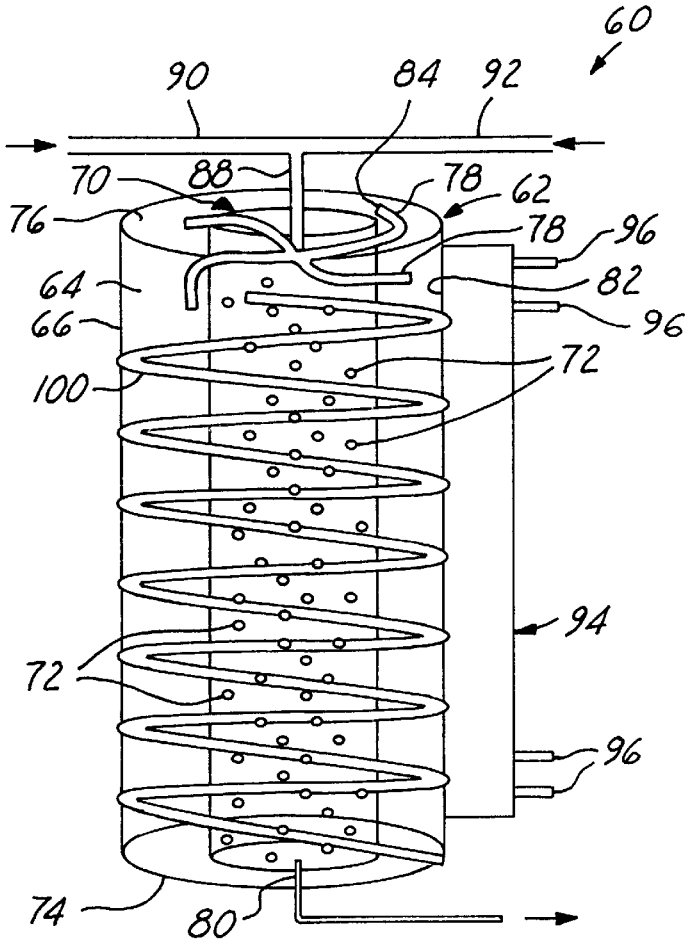
FIG. 2A is a view illustrating the present invention static mixer equipped with a mixing sleeve, a spiral plate and a plurality of curve linear feed tubes.
Figure 2B:
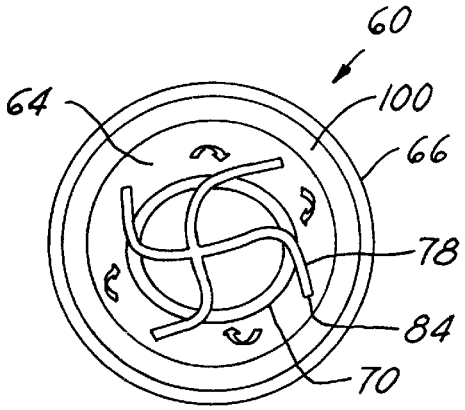
FIG. 2B is a plane view of the present invention static mixer of FIG. 2A.

The present invention static mixer 60 is shown in FIGS. 2A and 2B. In the static mixer 60, an elongated cylindrical tank body 62 is first provided. Inside the tank body 62, a cavity 64 is defined by the tank wall 66 which houses an elongated, cylindrical mixing sleeve 70 therein. The elongated, cylindrical mixing sleeve 70 has a diameter that is smaller than the diameter for the tank body 62 and is positioned in an upright position inside the tank body. The tank body 62 may be advantageously fabricated of a corrosion-resistant material such as stainless steel. The mixing sleeve 70 may be fabricated of a similar material, or of a corrosion-resistant polymeric material such as polypropylene.

The elongated, cylindrical mixing sleeve 70 has a multiplicity of mixing apertures 72 provided through the sleeve body. The multiplicity of mixing apertures 72 may suitably have a diameter between about 3 mm and about 15 mm, and more preferably between about 5 mm and about 10 mm. The word "about" used in this write-up indicates a range of values that is ±10% of the average value given. The multiplicity of mixing apertures 72 further enhances the mixing function by forcing a mixture of the viscous liquid and a solvent to flow through the multiplicity of mixing apertures when the final mixture is pumped out, or withdrawn from the outlet tube 80 situated at the bottom of the tank body 62 inside the sleeve 70.

At near a top wall 76 of the tank body 60, is mounted a plurality of curvilinear feed tubes 78 with an outlet extending away from a center of the tank body toward the interior surface 82 of the tank wall 66. The outlet 84 of the plurality of feed tubes 78 is shaped such that a spiral flow of the fluid mixture is produced when the mixture exits the feed tubes 78.

The plurality of feed tubes 78 is connected to feed conduits 88, which is further connected to feed conduits 90 and 92. In practice, a viscous slurry solution, a solvent such as ultra-pure water, and optionally an oxidizer solution may be fed into the feed conduit 90. A recirculated slurry solution from the mixing tank 62 may be fed into the tank body through feed conduit 92.

The present invention novel static mixer is further provided with a spiral plate 100 which is formed in a predetermined width, of approximately 10% of the diameter of the tank body 62, or of a width that is less than 2 cm. The spiral plate 100 is mounted juxtaposed to the interior surface 82 of the sidewall 66 in a spiral configuration such that it extends continuously downwardly from the top wall 76 to the bottom wall 74 of the tank cavity 64. The spiral plate 100 further assists in producing the spiral flow of the mixture after the flow exits the plurality of curvilinear feed tubes 78. The spiral flow of the mixture, as it goes down from the top of the mixing tank to the bottom of the mixing tank, gradually enters the mixing sleeve 70 through the multiplicity of mixing apertures 72 to further enhance the mixing efficiency. The negative pressure produced by a pump means (not shown) that is attached to the outlet tube 80 further promotes the flow from outside the mixing sleeve to inside the mixing sleeve.

The present invention static mixer 60 may further be provided with a sight glass 94 which is equipped with a plurality of level sensors 96. The sight glass 94 provides an easy observation of the mixture level inside the tank body 62, while the level sensors 96 of any electronic type provides an output signal to a controller for controlling the operation of the static mixer 60.

The present invention novel static mixer therefore permits a slurry concentrate, and oxidizer and UPW to be pumped into the mixer at the same time for high efficiency mixing. The incoming raw chemical blends with recirculating premixed slurry solution simultaneously to effectively eliminate any potential for pH shock in the mixed fluids. The solution enters the plurality of feed tubes with a kinetic energy and is injected into the mixing chamber, or cavity, descending in a spiral motion down the spiral plate and is further assisted by its gravity. The curvilinear feed tubes and the spiral plate contribute to the spiral flow in the mixing chamber and thus improving its mixing efficiency. The premixed recirculated slurry enters the mixing sleeve to further increase the mixing efficiency of the static mixer.

On top of the chamber cavity, and above the mixed It solution is an air space that is normally filled with a low pressure humidified air to keep the exposed surface of the slurry in a fresh condition. The slurry level in the mixer can be constantly monitored by a pair of level detectors for detecting a high and low level of the mixed solution. In the preferred embodiment, the fluid level is generally maintained at about 75% tank capacity. It has been found that in general, after a dispense cycle of the mixed slurry is completed, the mixture in the static mixer is made up of about 30 vol. % of old slurry and about 70 vol. % new slurry. Until the next dispense cycle is initiated, the mixture in the static mixer will be continuously recirculated through the mixer cavity. The slurry mixture is recirculated by pumping continuously in order to keep the mixture fresh and to avoid crystallization.

The present invention static mixer for a viscous liquid for use in a chemical mechanical polishing process has therefore been amply described in the above description and in the appended drawings of FIGS. 2A and 2B.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A static mixer for a viscous liquid comprising:

an elongated cylindrical tank having a cavity and a first diameter defined by a tank wall;

an elongated cylindrical mixing sleeve having a second diameter smaller than said first diameter situated inside said tank cavity, said mixing sleeve having a multiplicity of mixing apertures therethrough;

a plurality of curvilinear tubes situated near a top wall of said tank for flowing a mixture of said viscous liquid and a solvent into said tank cavity, each of said plurality of curvilinear tubes having an outlet extending outwardly away from a center of said tank cavity toward an interior surface of said tank wall generating a spiral flow of said mixture;

a spiral plate having a predetermined width positioned on said interior surface of said tank wall extending continuously from said top wall to a bottom wall of said tank; and an outlet tube situated in said bottom wall of said tank and inside said mixing sleeve for outputting said mixture.

2. A static mixer for a viscous liquid according to claim 1 further comprising a plurality of level sensors for sensing a level of said mixture.

3. A static mixer for a viscous liquid according to claim 1 further comprising a sight tube mounted on a sidewall of said elongated cylindrical tank for observing a level of said mixture.

4. A static mixer for a viscous liquid according to claim 1 further comprising said mixing sleeve mounted in an upright position inside said tank cavity when said elongated cylindrical tank is mounted in an upright position.

5. A static mixer for a viscous liquid according to claim 1, wherein said multiplicity of mixing apertures in said mixing sleeve having a diameter between about 3 mm and about 15 mm.

6. A static mixer for a viscous liquid according to claim 1, wherein said multiplicity of mixing apertures in said mixing sleeve preferably have a diameter between about 5 mm and about 10 mm.

7. A static mixer for a viscous liquid according to claim 1, wherein said second diameter of said mixing sleeve is at least 2 cm smaller than said first diameter of said elongated cylindrical tank.

8. A static mixer for a viscous liquid according to claim 1, wherein said plurality of curvilinear tubes being arranged such that each two of the tubes is in an S-shape with two outlets pointing toward said interior surface of the tank wall.

9. A static mixer for a viscous liquid according to claim 1, wherein said spiral plate being arranged along said interior surface of the tank wall for guiding said spiral flow of said mixture to said bottom wall of the tank and to enter said mixing sleeve through said mixing apertures.

10. A static mixer for a viscous liquid according to claim 1, wherein said predetermined width of said spiral plate being less than 10% of said first diameter of said elongated cylindrical tank.

11. A static mixer for a viscous liquid according to claim 1, wherein said predetermined width of said spiral plate being less than 2 cm.

12. A static mixer for a viscous liquid according to claim 1, wherein said plurality of curvilinear tubes further comprises an inlet in fluid communication with at least two inlet conduits.

13. A static mixer for a viscous liquid according to claim 12, wherein said at least two inlet conduits being a slurry feed conduit and a solvent conduit.

14. A static mixer for a viscous liquid according to claim 1, wherein said plurality of curvilinear tubes being fixedly mounted to said top wall of said tank.

15. A static mixer for a viscous liquid according to claim 1, wherein said spiral plate being fixedly mounted on said interior surface of said tank wall by welding means.

16. A static mixer for a viscous liquid according to claim 1, wherein said plurality of curvilinear tubes being at least four tubes each having an outlet toward said interior surface of the tank wall.

* * * * *